United States Patent [19]

Pepper

[11] Patent Number: 4,939,796

[45] Date of Patent: Jul. 10, 1990

[54] TOILET SEAT HINGE

[75] Inventor: Kenneth V. Pepper, Plymouth, Wis.

[73] Assignee: Bemis Manufacturing Company, Inc., Sheboygan Falls, Wis.

[21] Appl. No.: 260,006

[22] Filed: Oct. 19, 1988

[51] Int. Cl.[5] ..... A47K 13/12

[52] U.S. Cl. ..... 4/236; 4/234; 4/240

[58] Field of Search ..... 4/240, 236, 234, 237; 16/223, 228–265, 382, 385–386, 387, DIG. 18

[56] References Cited

U.S. PATENT DOCUMENTS

| | | | |
|---|---|---|---|
| 2,252,196 | 8/1941 | Parsons | 4/236 |
| 3,277,500 | 10/1966 | Carlson | 4/236 |
| 3,447,169 | 6/1969 | Watson | 4/240 |
| 3,754,300 | 8/1973 | Shepherd | 4/236 |
| 4,319,365 | 3/1982 | Bemis et al. | 4/236 |
| 4,391,001 | 7/1983 | Harrison | 4/236 |
| 4,514,356 | 4/1985 | Harrison | 4/236 |
| 4,742,582 | 5/1988 | Giallourkis | 4/661 X |

FOREIGN PATENT DOCUMENTS

| | | |
|---|---|---|
| 1069484 | 8/1963 | New Zealand . |
| 2124294 | 5/1983 | United Kingdom . |

*Primary Examiner*—Henry K. Artis

*Attorney, Agent, or Firm*—Michael, Best & Friedrich

[57] ABSTRACT

A toilet assembly comprising a toilet bowl, an upper member including a rearward end having a width, and only one hinge including a hinge post portion connected to the toilet bowl, and a hinge leaf portion which is pivotally connected to the upper member adjacent the rearward end of the upper member and which extends across substantially the entire width of the rearward end of the upper member.

16 Claims, 2 Drawing Sheets

TOILET SEAT HINGE

BACKGROUND OF THE INVENTION

The invention relates to toilets, and more particularly to hinges for toilet seats and/or covers.

A typical toilet seat hinge includes a hinge post, separate hinge leaves, and a pintle or pintles connecting the hinge leaves to the hinge post. The hinge members and pintles form crevices that can harbor dirt, moisture and germs. The hinge leaves are typically attached to the toilet seat by wood screws which penetrate the surface of the toilet seat. The screw threads form a conduit which, by capillary action, may draw dirt and moisture into the permeable core of the toilet seat. Also, wood screws themselves are vulnerable to corrosion, particularly from urine and cleaning materials and disinfectants. Furthermore, the wood screws can discolor surrounding material, and their heads and slots or keys harbor dirt.

The hinge posts of conventional hinge assemblies are attached to a toilet bowl with nuts and bolts. The smooth surface of the toilet bowl offers very little resistance to rotation of the mounting parts. At the same time, only limited clamping pressure can be applied to the toilet bowl because the china will crack if the nuts and bolts are overtightened. Therefore, lateral pressure applied to the front of the toilet seat tends to move the hinge mounting parts so they pivot about their center. Movement of the hinge leaves about the screw holes, movement of the hinge parts about the hinge pintles and the above-described movement of the mounting parts results in substantial possible lateral movement of the toilet seat. The front edges of a toilet seat are supported on the toilet bowl by bumper pads that rest on the bowl rim. Only a relatively small, flat surface exists on the bowl rim so that, with a small amount of lateral movement of the front of the toilet seat, the bumpers will slip over the edge of the rim. This problem is exacerbated by the weight of a person on the toilet seat.

Carlson U.S. Pat. No. 3,277,500 discloses the use of a pair of membrane or "living" hinges for a toilet seat and cover. Carlson's hinges magnify all of the above-described problems. First, Carlson utilizes wood screws to secure his hinge leaves to the toilet seat and cover. Second, the distance between the point at which Carlson's hinges are connected to the toilet seat and the point at which the hinges are connected to the toilet bowl is so great that, due to the low flexural modulus of the materials used by Carlson, the hinge leaves themselves are susceptible to considerable flexing.

SUMMARY OF THE INVENTION

The invention provides a toilet assembly comprising a single, one-piece hinge for connecting a toilet seat and cover to a toilet bowl. The hinge provided by the invention does not have any of the above-mentioned disadvantages of prior art hinges. Because no screws or pintles are employed, the seat and cover can move only pivotally about the desired axes. Lateral movement of the seat and cover is substantially prevented.

The toilet assembly comprises a toilet bowl having a rearward end and an upper surface. The upper surface has therein a pair of apertures. The assembly also comprises a seat movable between an open position and a closed position and including a rearward end and a rear surface which extends generally vertically when the seat is in the closed position. The rear surface has therein a slot which extends across substantially the entire width of the rearward end of the seat. The assembly also comprises a cover movable between an open position and a closed position and including a rearward end and a lower surface which extends generally horizontally when the cover is in the closed position. The lower surface has therein a slot which is located adjacent the rearward end of the cover and which extends across substantially the entire width of the rearward end of the cover.

The one-piece hinge includes a hinge post portion connected to the upper surface of the toilet bowl adjacent the rearward end thereof. More particularly, the hinge post portion has therein a pair of apertures aligned with the apertures in the toilet bowl, and the hinge post portion is connected to the toilet bowl by bolts extending through the apertures in the hinge post portion and through the apertures in the toilet bowl. The bolts are secured to the toilet bowl by nuts.

The hinge also includes a first hinge leaf portion connected to the hinge post portion via a living hinge for pivotal movement relative to the hinge post portion about a first generally horizontal axis. The first hinge leaf portion is connected to the lower surface of the cover so that the first hinge leaf portion extends generally horizontally when the cover is in the closed position, and the first hinge leaf portion extends across substantially the entire width of the rearward end of the cover. The first hinge leaf portion has thereon a projection which is housed in the slot in the cover and which has therein an undercut, and the first hinge leaf portion is secured to the cover by an adhesive which fills the slot in the cover, which fills the undercut in the projection and which adheres to the cover. When the adhesive hardens, it prevents the projection from being withdrawn from the slot. The adhesive thereby secures the first hinge leaf portion to the cover.

The hinge also includes a second hinge leaf portion connected to the hinge post portion via a living hinge for pivotal movement relative to the hinge post portion about a second axis spaced from and parallel to the first axis. Preferably, the second axis is located forwardly and downwardly relative to the first axis. The second hinge leaf portion is connected to the rear surface of the seat so that the second hinge leaf portion extends generally vertically when the seat is in the closed position. The second hinge leaf portion extends across substantially the entire width of the rearward end of the seat and has thereon a projection housed in the slot in the seat. The projection on the second hinge leaf portion has therein an undercut, and an adhesive in the slot in the seat secures the second hinge leaf portion to the seat.

Other features and advantages of the invention will become apparent to those skilled in the art upon review of the following detailed description, claims and drawings.

Figure 1:
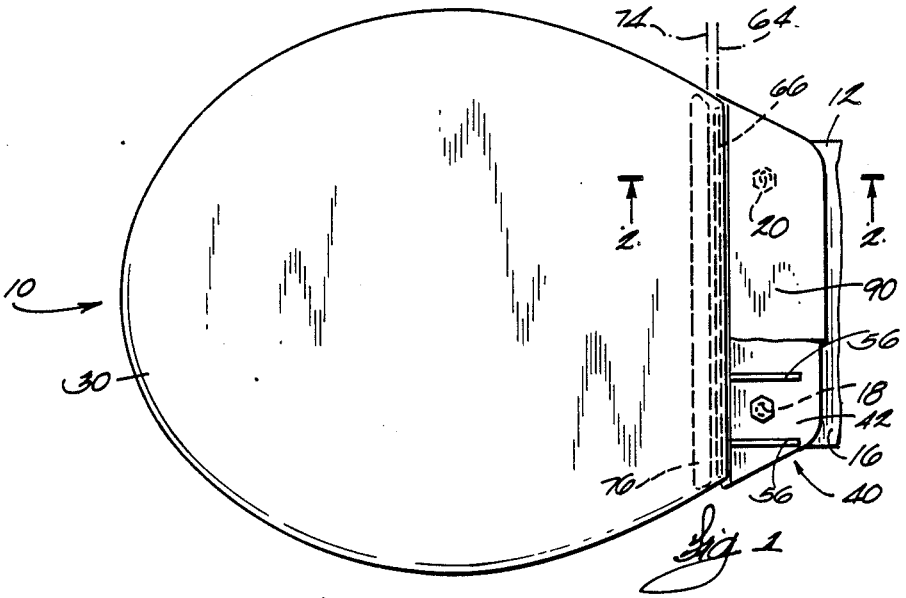
FIG. 1 is a plan view of a toilet assembly embodying the invention and including a one piece hinge.

Before one embodiment of the invention is explained in detail, it is to be understood that the invention is not limited in its application to the details of construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DESCRIPTION OF THE PREFERRED EMBODIMENT

Figure 2:
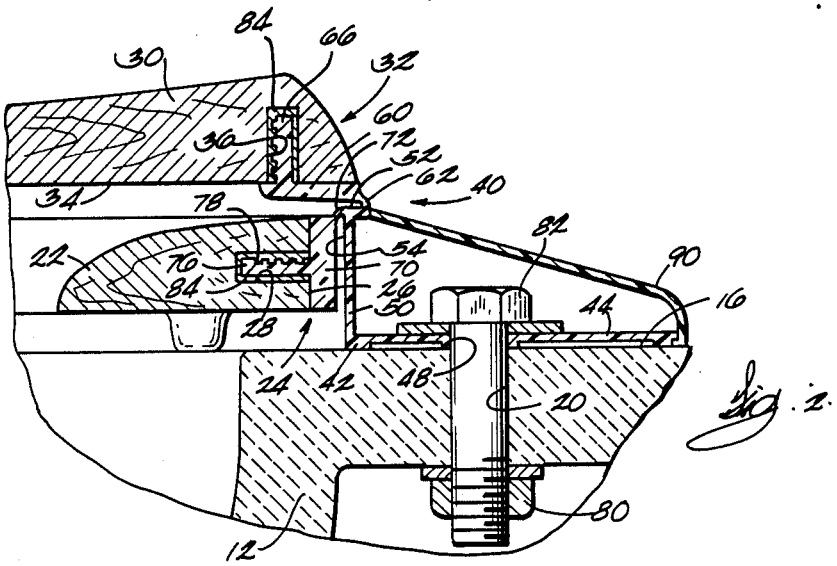
FIG. 2 is an enlarged, partial sectional view taken along line 2—2 in FIG. 1.

A toilet assembly 10 embodying the invention is illustrated in the drawings. The toilet assembly 10 comprises a toilet bowl 12 (partially shown in FIG. 2) having a rearward end (to the right in FIG. 2) and an upper surface 16. The upper surface 16 has therein spaced apertures 18 (FIG. 1) and 20 (FIGS. 1 and 2). This construction is conventional.

The toilet assembly 10 also comprises a first member or seat 22 (partially shown in FIG. 2) movable between an open position (not shown) and a closed position (shown in FIG. 2). The seat 22 includes (see FIG. 2) a rearward end 24 and a rear surface 26 which extends generally vertically when the seat 22 is in the closed position, as shown in FIG. 2. The rear surface 26 of the seat 22 has therein a slot 28 which extends across substantially the entire width of the rearward end 24 of the seat 22. The reason for the slot 28 is explained hereinafter.

The toilet assembly 10 also comprises (see FIGS. 1 and 2) a second member or cover 30 movable between an open position (not shown) and a closed position (FIGS. 1 and 2). The cover 30 includes (see FIG. 2) a rearward end 32 and a lower surface 34 which extends generally horizontally when the cover 30 is in the closed position. The lower surface 34 of the cover 30 has therein a slot 36 which is located adjacent the rearward end 32 of the cover 30 and which extends across substantially the entire width of the rearward end 32 of the cover 30. The reason for the slot 36 is explained hereinafter. The seat 22 and cover 30 are preferably made of a resin-bonded wood flour.

Figure 3:
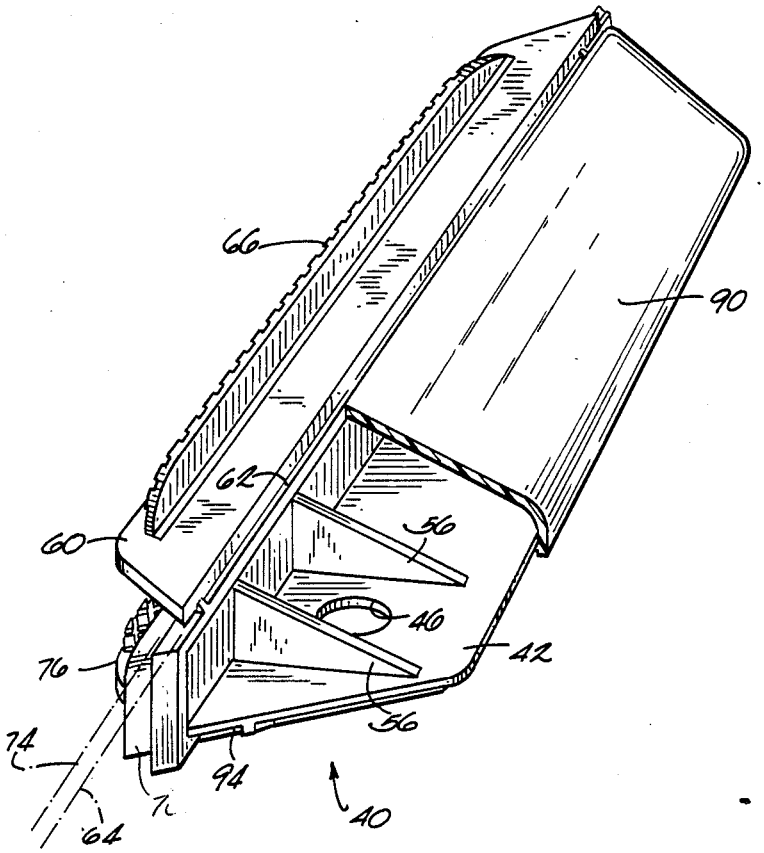
FIG. 3 is a perspective view of the hinge.

The toilet assembly 10 also comprises a single, one-piece hinge 40. In the preferred embodiment, the hinge 40 is made of injection molded polypropylene. The hinge 40 includes (see FIGS. 2 and 3) a hinge post portion 42 connected to the upper surface 16 of the toilet bowl 12 adjacent the rearward end thereof. The manner in which the hinge post portion 42 is connected to the toilet bowl 12 is described hereinafter. The hinge post portion 42 includes a generally horizontal section 44 resting on the upper surface 16 of the toilet bowl 12 and having therein spaced apertures 46 (FIG. 3) and 48 (FIG. 2) respectively aligned with the apertures 18 and 20 in the toilet bowl 12. The hinge post portion 42 also includes a generally vertical section 50 extending upwardly from the horizontal section 44 and having (see FIG. 2) an upper surface 52 and a forward surface 54. Integral brace members 56 (FIG. 3) connect the vertical section 50 to the horizontal section 44.

Figure 4:
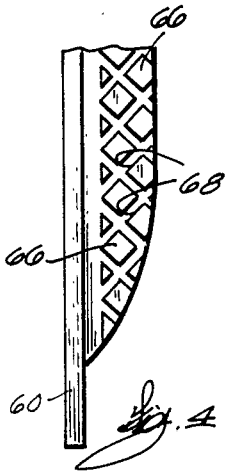
FIG. 4 is a view of one of the hinge leaf portions of the hinge.
Figure 5:
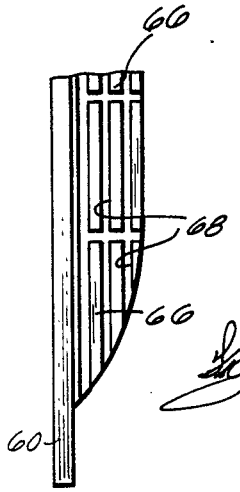
FIG. 5 is a view similar to FIG. 4 and illustrating an alternative hinge leaf construction.

The hinge 40 also includes a first hinge leaf portion 60 integrally connected to the hinge post portion 42 via a living hinge 62 for pivotal movement relative to the hinge post portion 42 about a first generally horizontal axis 64. In the preferred embodiment, the living hinge 62 connects the hinge leaf portion 60 to the upper surface 52 of the vertical section 50 along a line adjacent the rearward end of the upper surface 52. The hinge leaf portion 60 is connected to the lower surface 34 of the cover 30 so that the hinge leaf portion 60 extends generally horizontally and forwardly from the axis 64 when the cover 30 is in its closed position. The manner in which the hinge leaf portion 60 is connected to the cover 30 is described hereinafter. The hinge leaf portion 60 extends across substantially the entire width of the rearward end 32 of the cover 30, and the hinge leaf portion 60 has thereon a projection 66 which is housed in the slot 36 in the cover 30. The projection 66 has therein (see FIG. 4) a plurality of grooves 68 defining undercuts in the projection 66. An alternative groove arrangement is illustrated in FIG. 5.

The hinge 40 also includes a second hinge leaf portion 70 connected to the hinge post portion 42 via a living hinge 72 for pivotal movement relative to the hinge post portion 42 about a second axis 74 spaced from and parallel to the first axis 64. In the preferred embodiment, the living hinge 72 connects the hinge leaf portion 70 to the forward surface 54 of the vertical section 50 along a line adjacent the upper surface 52 of the vertical section 50 so that the second axis 74 is located forwardly relative to the first axis 64. The second axis 74 is also located slightly downwardly relative to the first axis 64. The hinge leaf portion 70 is connected to the rear surface 26 of the seat 22 so that the hinge leaf portion 70 extends generally vertically and downwardly from the axis 74 when the seat 22 is in its closed position. The manner in which the hinge leaf portion 70 is connected to the seat 22 is described hereinafter. The hinge leaf portion 70 extends across substantially the entire width of the rearward end 24 of the seat 22, and the hinge leaf portion 70 has thereon a projection 76 housed in the slot 28 in the seat 22. The projection 76 has therein (see FIGS. 2 and 3) a plurality of grooves 78 which are similar to the grooves 68 in the projection 66 and which define undercuts in the projection 76.

The toilet assembly 10 further comprises first connecting means extending through the aperture 46 in the hinge post portion 42 and through the aperture 18 in the bowl 12 for securing the hinge post portion 42 to the bowl 12, and second connecting means extending through the aperture 48 in the hinge post portion 42 and through the aperture 20 in the bowl 12 for securing the hinge post portion 42 to the bowl 12. While various suitable connecting means can be employed, in the preferred embodiment, such means include (see FIG. 2) conventional nuts 80 and bolts 82.

The toilet assembly 10 also comprises first adhesive means for securing the hinge leaf portion 60 to the cover 30. The first adhesive means is located in the slot 36 in the cover 30, fills the undercuts or grooves 68 in the projection 66 and adheres to the cover 30. The toilet assembly 10 further comprises second adhesive means for securing the hinge leaf portion 70 to the seat 22. The second adhesive means is located in the slot 28 in the seat 22, fills the grooves or undercuts 78 in the projection 76 and adheres to the seat 22. While various suitable adhesive means can be used, in the preferred embodiment, the first and second adhesive means include (see FIG. 2) a flowable resin 84 such as polyurethane, epoxy or polyester resin. The resin 84 fills the slot 28 and adheres to the resin-bonded wood material of the seat 22 and cover 30.

The resin 84 is used in the same manner to secure the hinge leaf portion 60 to the cover 30 and to secure the hinge leaf portion 70 to the seat 22. Only the method of connecting the hinge leaf portion 60 to the cover 30 will be described in detail. First, a predetermined quantity of resin 84 is placed in the bottom of the slot 36. Next, the projection 66 on the hinge leaf portion 60 is inserted into the slot 36. Insertion of the projection 66 into the slot 36 causes the resin 84 to flow around the projection 66 and into the grooves or undercuts 68, thereby filling the undercuts 68. The resin 84 also fills the space between the projection 66 and the walls of the slot 36. Upon hardening, the resin 84 adheres to the cover 30 and cannot be removed from the slot 36. Because the resin 84 fills the undercuts 68 in the projection 66, it also provides a mechanical interlock which prevents the projection 66 from being removed from the slot 36. Thus, the resin 84 secures the hinge leaf portion 60 to the cover 30.

Preferably, the toilet assembly 10 also comprises a cover member or shield 90 which is removably secured to the horizontal section 44 of the hinge post portion 42 to shield the heads of the bolts 82. The shield 90 keeps dirt and moisture away from the bolts 82 and the apertures 46 and 48 and is also aesthetically pleasing. In the preferred embodiment, the shield 90 is flexible and is removably secured to the hinge post portion 42 via projections (not shown) on the shield 90 and recesses 94 (FIG. 3) in the hinge post portion 42.

Various features of the invention are set forth in the following claims.

I claim:

1. A toilet assembly comprising a toilet bowl, a member including a rearward end having a width, and having therein a slot which is located adjacent said rearward end of said member and which extends across substantially the entire width of said rearward end of said member, only one hinge including a hinge post portion connected to said toilet bowl, and a hinge leaf portion which is pivotally connected to said hinge post portion, and which includes thereon a projection which is housed in said slot in said member, which extends across substantially the entire width of said rearward end of said member, and which has therein an undercut, and adhesive means for securing said hinge leaf portion to said member, said adhesive means being located in said slot in said member, filling said undercut in said projection, and adhering to said member.

2. A toilet assembly as set forth in claim 1 wherein said toilet bowl has therein spaced first and second apertures, wherein said hinge post portion has therein spaced first and second apertures, and wherein said assembly further comprises first connecting means extending through said first aperture in said hinge post portion and said first aperture in said bowl for securing said hinge post portion to said bowl, and second connecting means extending through said second aperture in said hinge post portion and said second aperture in said bowl for securing said hinge post portion to said bowl.

3. A toilet assembly comprising a toilet bowl, a member having a rearward end including therein a slot, a hinge including a hinge post portion connected to said toilet bowl, and a hinge leaf portion connected to said hinge post portion for pivotal movement relative thereto and including a projection extending into said slot, and connecting means for securing said projection on said hinge leaf portion in said slot in said member and comprising a substance adhesively secured to said member and mechanically interlocked with said projection.

4. A toilet assembly comprising a toilet bowl, a member including a rearward end, a hinge including a hinge post portion connected to said toilet bowl, and a hinge leaf portion connected to said hinge post portion for pivotal movement relative thereto, and means for securing said hinge leaf portion to said member, a slot in said rearward end of said member, a projection forming part of said hinge leaf portion, extending into said slot in said member and including therein an undercut, and a resin located in said slot in said member, adhering to said member, and rigidly extending into said undercut in said projection to effect a mechanical interlock therewith.

5. A toilet assembly as set forth in claim 3 wherein said toilet bowl has therein spaced first and second apertures, wherein said hinge post portion has therein spaced first and second apertures, and wherein said assembly further comprises first connecting means extending through said first aperture in said hinge post portion and said first aperture in said bowl for securing said hinge post portion to said bowl, and second connecting means extending through said second aperture in said hinge post portion and said second aperture in said bowl for securing said hinge post portion to said bowl.

6. A toilet assembly comprising a toilet bowl having a rearward end and an upper surface, a seat, a cover, and a hinge including a hinge post portion connected to said upper surface of said toilet bowl adjacent said rearward end thereof, a seat hinge leaf portion connected to said seat and connected to said hinge post portion for pivotal movement relative thereto about a first axis, and a cover hinge leaf portion connected to said cover and connected to said hinge post portion for pivotal movement relative thereto about a second axis spaced from and parallel to said first axis, said cover hinge leaf portion being pivotally connected to said hinge post portion independently of the pivotal connection of said seat hinge leaf portion to said hinge post portion.

7. A toilet assembly as set forth in claim 6 wherein said first axis is located forwardly relative to said second axis.

8. A toilet assembly as set forth in claim 7 wherein said first axis is located downwardly relative to said second axis.

9. A toilet assembly as set forth in claim 6 wherein said toilet bowl has therein spaced first and second apertures, wherein said hinge post portion has therein spaced first and second apertures, and wherein said assembly further comprises first connecting means extending through said first aperture in said hinge post portion and said first aperture in said bowl for securing said hinge post portion to said bowl, and second connecting means extending through said second aperture in said hinge post portion and said second aperture in said bowl for securing said hinge post portion to said bowl.

10. A toilet assembly comprising a toilet bowl having a rearward end and an upper surface, a seat including, a rearward end having a width, and having therein a slot which extends across substantially the entire width of said rearward end of said seat, a cover including a rearward end having a width and having therein a slot which extends across substantially the entire width of said rearward end of said cover, and a hinge including a hinge post portion connected to said upper surface of said toilet bowl adjacent said rearward end thereof, a first hinge leaf portion connected to said hinge post portion for pivotal movement relative thereto about a first axis and including a first projection extending in and for the entire width of said slot in said cover, said first projection having therein an undercut, a second hinge leaf portion connected to said hinge post portion for pivotal movement relative thereto about a second axis spaced from and parallel to said first axis and including a second projection extending in and for the entire width of said slot in said seat, said second projection having therein an undercut, first adhesive means for securing said first hinge leaf portion to said cover, said first adhesive means being located in said slot in said cover, extending into said undercut in said first projection and adhering to said cover, and second adhesive means for securing said second hinge leaf portion to said seat, said second adhesive means being located in said slot in said seat, extending into said undercut in said second projection and adhering to said seat.

11. A toilet assembly comprising a toilet bowl having an upper surface, a seat movable between an open position and a closed position and including a rear surface which extends generally vertically when said seat is in said closed position, a cover movable between an open position and a closed position and including a lower surface which extends generally horizontally when said cover is in said closed position, and a one-piece hinge including a hinge post portion connected to said upper surface of said toilet bowl, a first hinge leaf portion connected to said hinge post portion for pivotal movement relative thereto, said first hinge leaf portion being connected to said lower surface of said cover so that said first hinge leaf portion extends generally horizontally when said cover is in said closed position, and a second hinge leaf portion connected to said hinge post portion for pivotal movement relative thereto, said second hinge leaf portion being connected to said rear surface of said seat so that said second hinge leaf portion extends generally vertically when said seat is in said closed position.

12. A one-piece hinge adapted for use with a toilet assembly including a toilet bowl having a rearward end and an upper surface, a seat, and a cover, said hinge comprising a hinge post portion adapted to be connected to the upper surface of the toilet bowl adjacent the rearward end thereof, a seat hinge leaf portion adapted to be connected to said seat and connected to said hinge post portion for pivotal movement relative thereto about a first axis, and a cover hinge leaf portion adapted to be connected to said cover and connected to said hinge post portion for pivotal movement relative thereto about a second axis spaced from and parallel to said first axis, said cover hinge leaf portion being pivotally connected to said hinge post portion independently of the pivotal connection of said seat hinge leaf portion to said hinge post portion.

13. A hinge as set forth in claim 12 wherein said first axis is located forwardly relative to said second axis.

14. A hinge as set forth in claim 13 wherein said first axis is located downwardly relative to said second axis.

15. A hinge as set forth in claim 12 wherein the toilet bowl has therein spaced first and second apertures, wherein said hinge post portion has therein spaced first and second apertures, and wherein said hinge further comprises first connecting means extending through said first aperture in said hinge post portion and adapted to extend through the first aperture in the bowl for securing said hinge post portion to the bowl, and second connecting means extending through said second aperture in said hinge post portion and adapted to extend through the second aperture in the bowl for securing said hinge post portion to the bowl.

16. A one-piece hinge adapted for use with a toilet assembly including toilet bowl having a rearward end and an upper surface, a seat including a rearward end having a width and having therein a slot which extends across substantially the entire width of the rearward end of the seat, and a cover including a rearward end having a width and having therein a slot which extends across substantially the entire width of the rearward end of the cover, said hinge comprising a hinge post portion adapted to be connected to the upper surface of the toilet bowl adjacent the rearward end thereof, a first hinge leaf portion connected to said hinge post portion for pivotal movement relative thereto about a first axis and including a first projection adapted to extend in and for the entire width of the slot in the cover, said first projection having therein an undercut, and a second hinge leaf portion connected to said hinge post portion for pivotal movement relative thereto about a second axis spaced from and parallel to said first axis and including a second projection adapted to extend in and for the entire width of the slot in the seat, said second projection having therein an undercut.

* * * * *